US011701529B2

(12) United States Patent
Gao

(10) Patent No.: US 11,701,529 B2
(45) Date of Patent: Jul. 18, 2023

(54) AIR SUPPLY MECHANISM WITH LOWER AIR DUCT, HEADGEAR AND ELECTRIC PROTECTIVE EQUIPMENT

(71) Applicant: CHANGZHOU SHINE SCIENCE & TECHNOLOGY CO., LTD., Changzhou (CN)

(72) Inventor: Weiren Gao, Changzhou (CN)

(73) Assignee: CHANGZHOU SHINE SCIENCE & TECHNOLOGY CO., LTD., Jiangsu (CN)

( * ) Notice: Subject to any disclaimer, the term of this patent is extended or adjusted under 35 U.S.C. 154(b) by 90 days.

(21) Appl. No.: 17/561,934

(22) Filed: Dec. 25, 2021

(65) Prior Publication Data

US 2022/0219024 A1 Jul. 14, 2022

Related U.S. Application Data

(63) Continuation of application No. PCT/CN2021/072970, filed on Jan. 21, 2021.

(30) Foreign Application Priority Data

Jan. 8, 2021 (CN) ..... 202110021956.X

(51) Int. Cl.
*A62B 23/02* (2006.01)
*A62B 7/10* (2006.01)
(Continued)

(52) U.S. Cl.
CPC ..... *A62B 23/02* (2013.01); *A41D 13/11* (2013.01); *A62B 7/10* (2013.01); *A62B 18/003* (2013.01); *A62B 18/04* (2013.01)

(58) Field of Classification Search
CPC ... A62B 7/00–04; A62B 7/10–12; A62B 9/00; A62B 9/04; A62B 17/00–001;
(Continued)

(56) References Cited

U.S. PATENT DOCUMENTS 4,011,865 A 3/1977 Morishita
2020/0206546 A1* 7/2020 Kim ..... A62B 23/025
(Continued)

FOREIGN PATENT DOCUMENTS

CN 107890615 A 4/2018
CN 207342044 U 5/2018
(Continued)

*Primary Examiner* — Rachel T Sippel
(74) *Attorney, Agent, or Firm* — SZDC Law P.C.

(57) ABSTRACT

An air supply mechanism with lower air duct, a headgear and an electric protective equipment are disclosed. The air supply mechanism with lower air duct includes: an air inlet mask, the front of the air inlet mask being raised in an arc shape and the back of the air inlet mask being arranged to fit to the human face, the air inlet mask including a first ventilation structure and a second ventilation structure connecting the front and back; an air supply pipe fixed on one side of the air inlet mask and in communication with the first ventilation structure and the second ventilation structure to supply air to the front of the air inlet mask; and a filter screen fixedly covering the first ventilation structure to filter the air entering the first ventilation structure from the front of the air inlet mask.

5 Claims, 7 Drawing Sheets

(51) Int. Cl.
*A62B 18/04* (2006.01)
*A62B 18/00* (2006.01)
*A41D 13/11* (2006.01)

(58) Field of Classification Search
CPC ..... A62B 17/04; A62B 18/00–02; A62B 18/04–084; A62B 18/088; A62B 23/00–025; A41D 13/11
See application file for complete search history.

(56) References Cited

U.S. PATENT DOCUMENTS

| | | | | |
|---|---|---|---|---|
| 2022/0339470 | A1* | 10/2022 | Bowden | A61M 15/0001 |
| 2023/0039501 | A1* | 2/2023 | Heusser | A62B 18/084 |

FOREIGN PATENT DOCUMENTS

| | | | |
|---|---|---|---|
| CN | 211751919 | U | 10/2020 |
| CN | 211835891 | U | 11/2020 |

* cited by examiner

AIR SUPPLY MECHANISM WITH LOWER AIR DUCT, HEADGEAR AND ELECTRIC PROTECTIVE EQUIPMENT

This application is a Continuation Application of PCT/CN2021/072970, filed on Jan. 21, 2021, which claims priority to Chinese Patent Application No. 202110021956.X, filed on Jan. 8, 2021, all of which are incorporated by reference for all purposes as if fully set forth herein.

TECHNICAL FIELD

The present invention relates to the field of headgear, in particular to an air supply mechanism with lower air duct, a headgear and an electric protective equipment.

BACKGROUND

In the field of mechanical processing, especially in the field of welding and grinding where a protective headgear is required, electric protective equipment has been paid more and more attention with the increasing awareness of occupational health and personal protection. This is because in a working environment with poor air quality, electric protective equipment can filter out air that is hazardous to human health and thus reduce harm to the human body.

In the prior art, direct blowing is often used to send the filtered air into the headgear, so as to provide fresh air for operators. However, the above-mentioned direct blowing method may cause discomfort for long-term use, especially to the eyes, mouth, and nose, causing problems such as dry eyes, dry mouth and dry tongue.

The information disclosed in this background section is only intended to deepen the understanding of the overall background of the present invention, and should not be regarded as an acknowledgment or any form of suggestion that the information constitutes the prior art known to those skilled in the art.

SUMMARY

The technical problem to be solved by the present invention is to provide an air supply mechanism with lower air duct, a headgear and an electric protective equipment, so as to improve the comfort of the operator during use.

To this end, the present invention adopts technical solutions detailed below.

In one aspect, the present invention provides an air supply mechanism with lower air duct comprising:

an air inlet mask, the front of the air inlet mask being raised in an arc shape and the back of the air inlet mask being arranged to fit to the human face, the air inlet mask including a first ventilation structure and a second ventilation structure connecting the front and back;

an air supply pipe fixed on one side of the air inlet mask and in communication with the first ventilation structure and the second ventilation structure to supply air to the front of the air inlet mask;

a filter screen fixedly covering the first ventilation structure to filter the air entering the first ventilation structure from the front of the air inlet mask;

wherein when the air inlet mask fits to the human face, the first ventilation structure is arranged at the position of the nose and mouth and the second ventilation structure is arranged under the eyes, the first ventilation structure is provided with a plurality of ventilation holes, and the second ventilation structure is provided with an air inlet duct arranged toward the upper side in the height direction of the air inlet mask, the front side of the air inlet mask is semi-closed or fully closed, and the air blown by the air supply pipe partially or completely passes into the first ventilation structure and the second ventilation structure, and the diameter of the filter holes of the filter screen is not greater than 2 mm.

Further, the plurality of ventilation holes is provided with a ventilation pipe, one end of the ventilation pipe is connected to the front of the air inlet mask where the ventilation holes are located, and the other end extends away from the air inlet mask.

Further, the diameter of the end of the ventilation pipe away from the air inlet mask is less than the diameter of the end close to the air inlet mask.

Further, the first ventilation structure further includes an enclosure arranged perpendicular to the body of the air inlet mask and surrounding the plurality of the ventilation holes to form an air inlet chamber.

Further, the height of the enclosure close to the air supply pipe is lower than the height of the enclosure away from the air supply pipe.

Further, the enclosure is arranged open at a central position between the upper and lower sides in the height direction of the air inlet mask.

Further, the length direction of the air supply pipe is substantially perpendicular to the body of the air inlet mask, the side of the air inlet mask is recessed inward to form a fixing groove, the side wall of the fixing groove is arranged to replica the shape of the side wall where the air supply pipe is fixed.

Further, the filter screen may be detachably fixed to the air inlet mask.

The filter screen may be fixed in the air inlet mask by fasteners.

Alternatively, a snap structure is provided at a central position between two ends of the filter screen in the width direction, the first ventilation structure is provided with a bayonet corresponding to the snap structure, and the snap structure is detachably seated in the bayonet.

In another aspect, the present invention provides a headgear comprising:

an air supply mechanism with lower air duct described above and a semi-open hood, the semi-open hood including an internal space for at least covering the human face and an observation window at its front end, the air supply mechanism with lower air duct being fixed inside the semi-open hood;

wherein the edge of the air inlet mask in the air supply mechanism with lower air duct extends and bends toward the direction of the semi-open hood, so as to form an air inlet chamber between the air inlet mask and the semi-open hood.

In yet another aspect, the present invention also provides an electric protective equipment comprising a headgear described above, a filter-type blower, and a connecting hose connected to the filter-type blower at one end and the air supply pipe in the air supply mechanism with lower air duct at the other end.

The present invention is advantageous in that through the arrangement of the ventilation holes at the first ventilation structure on the air inlet mask and the filter screen fixed at the first ventilation structure, the wind entering the mouth and nose from the first ventilation structure becomes more soft and delicate after being filtered through the filter screen, improving the comfort of human body when wearing it, and that through the arrangement of the second ventilation structure, the air inlet duct blows from the inside of the air inlet mask to the observation window of the headgear, preventing the window from fogging and improving the reliability of use.

DESCRIPTION OF THE DRAWINGS

In order to more clearly illustrate the embodiments of the invention or the technical solutions in the prior art, the accompanying drawings to be used in the description of the embodiments or prior art will be briefly described below. It is obvious that the accompanying drawings in the following description are only some of the embodiments recorded in the present invention, and other accompanying drawings can be obtained according to these accompanying drawings without creative work for those of ordinary skill in the art.

DETAILED DESCRIPTION

Figure 1:
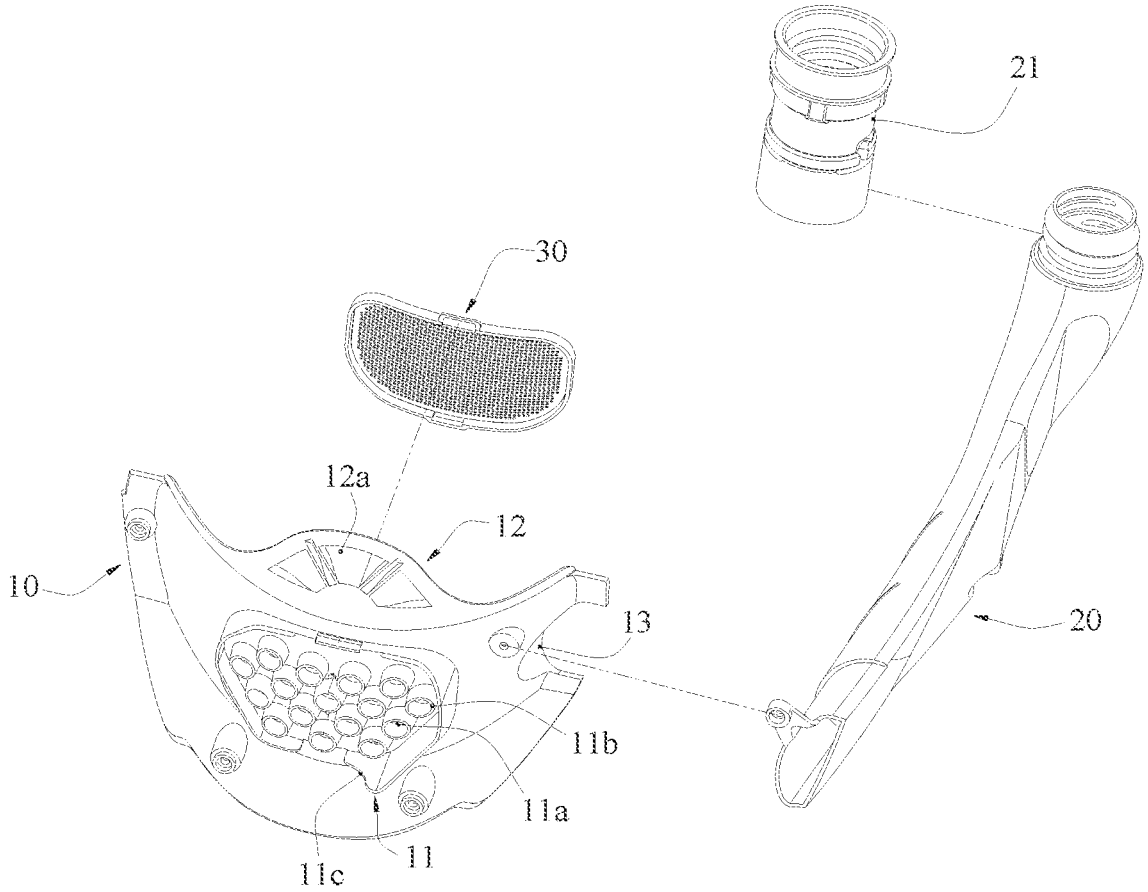
FIG. 1 is a schematic diagram of the exploded structure of the air supply mechanism with lower air duct according to an embodiment of the present invention.

The technical solutions in the embodiments of the present invention will be described clearly and completely in conjunction with the accompanying drawings in the embodiments of the present invention. Obviously, the described embodiments are only a part of the embodiments of the present invention, rather than all the embodiments.

It should be noted that when an element is referred to as being "fixed to" another element, it can be directly on the another element or an intermediate element may also be present. It should be noted that when an element is referred to as being "connected to" another element, it can be directly on the another element or an intermediate element may also be present. The terms "vertical," "horizontal," "left," "right," and similar expressions used herein are for illustrative purposes only and do not mean that they are the only mode of implementation.

Unless otherwise defined, all technical and scientific terms used herein have the same meaning as commonly understood by those skilled in the art of the present invention. The terms used herein are for the purpose of describing specific embodiments only and are not intended to limit the invention. The term "and/or" as used herein includes any and all combinations of one or more of the related listed items.

In one aspect, the present invention provides an air supply mechanism with lower air duct comprising an air inlet mask 10, an air supply pipe 20 and a filter screen 30.

The front of the air inlet mask 10 is raised in an arc shape and the back of the air inlet mask 10 is arranged to fit to the human face, the air inlet mask 10 includes a first ventilation structure 11 and a second ventilation structure 12 connecting the front and back. It should be noted here that the air inlet mask 10 may be made of plastic or metal and integrally formed by injection molding, and fitting to the human face here means that the mask has a curvature that substantially matches the human face and does not mean that it is exactly the same shape as the human face.

Figure 2:
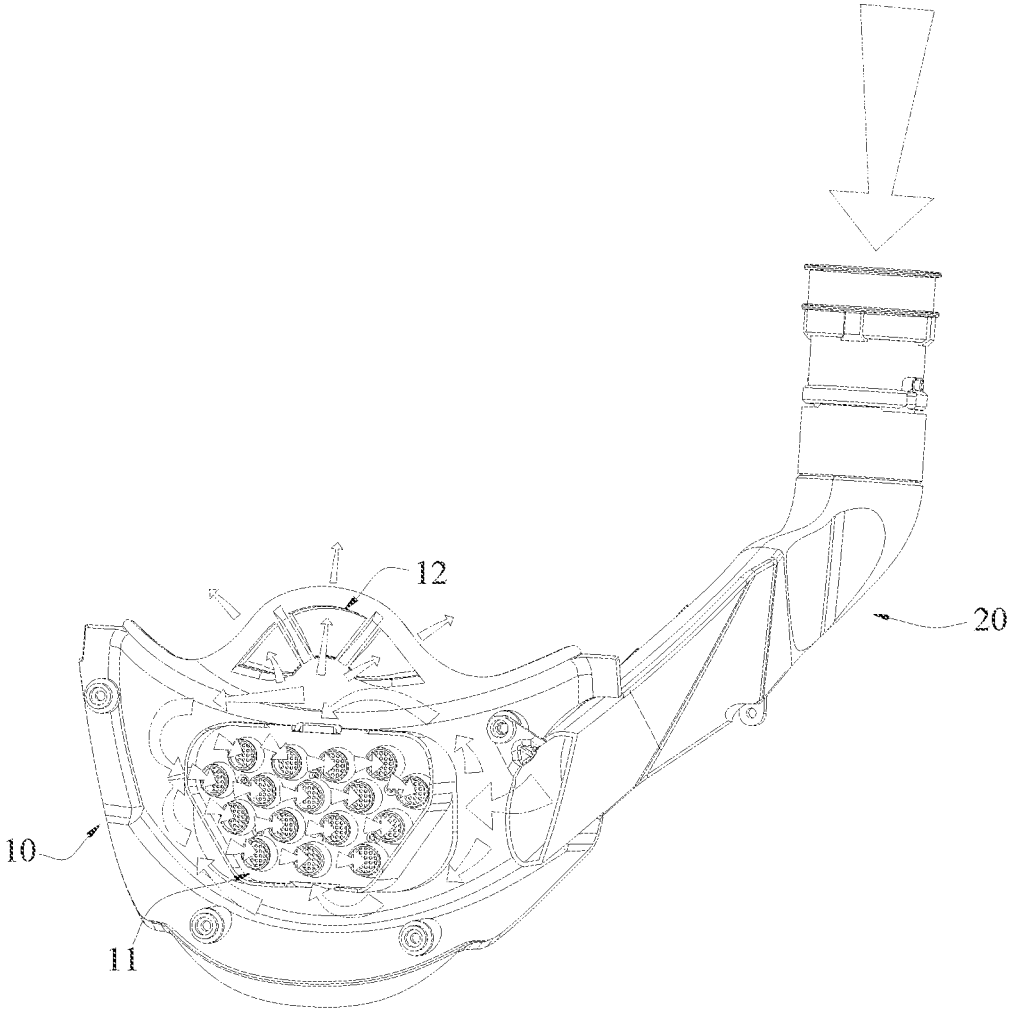
FIG. 2 is a schematic diagram of the air flow direction in the air supply mechanism with lower air duct according to an embodiment of the present invention.

The air supply pipe 20 is fixed on one side of the air inlet mask 10 and in communication with the first ventilation structure 11 and the second ventilation structure 12 to supply air to the front of the air inlet mask 10. As shown in FIG. 2, one end of the air supply pipe 20 is fixed to the front end of the air inlet mask 10 to feed the air from the other end to the front end of the air inlet mask 10, and then pass the air into the first ventilation structure 11 and the second ventilation structure 12, and then the air blows on the human face.

The filter screen 30 fixedly covers the first ventilation structure 11 to filter the air entering the first ventilation structure 11 from the front of the air inlet mask 10. The arrangement of the filter screen 30 can refine the wind blown from the first ventilation structure 11, thereby reducing the pressure of the wind on the human face and thus reducing the discomfort of the human face.

Figure 3:
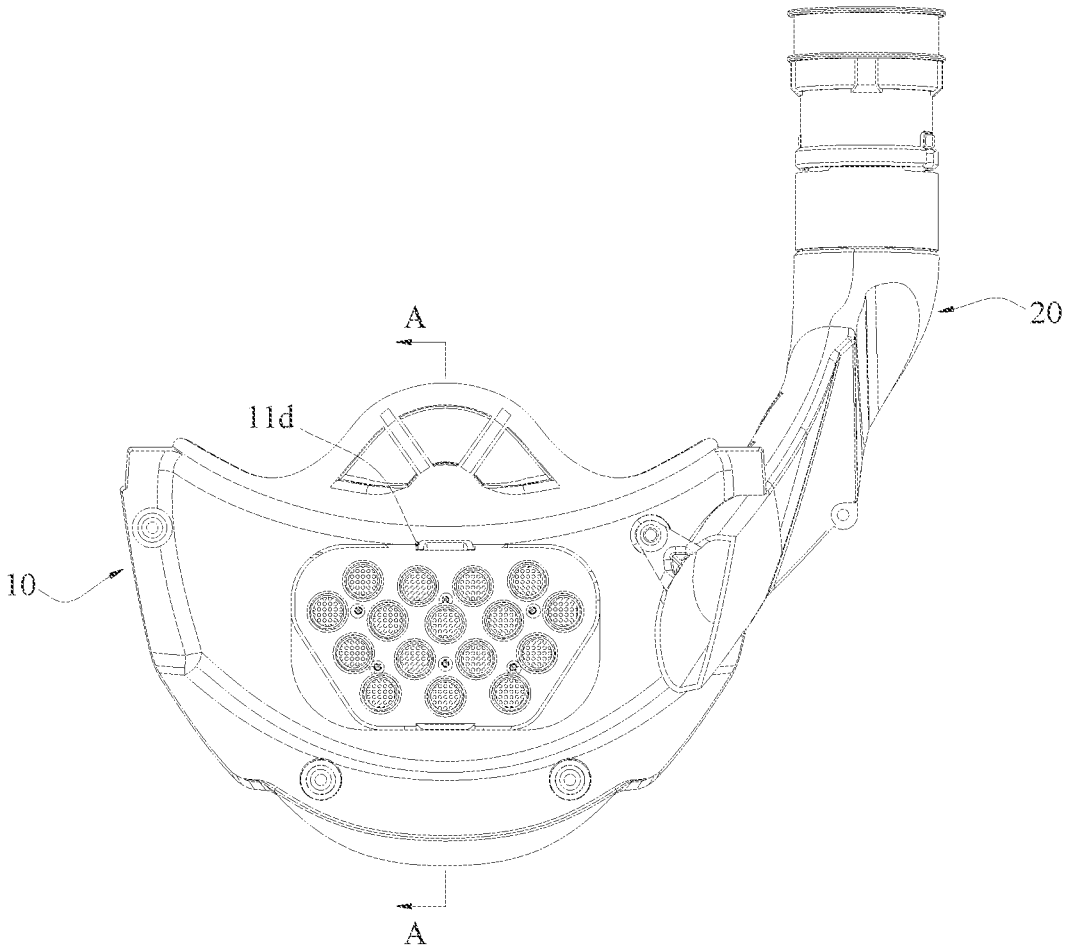
FIG. 3 is a front view of the air supply mechanism with lower air duct according to an embodiment of the present invention.

When the air inlet mask 10 fits to the human face, the first ventilation structure 11 is arranged at the position of the nose and mouth and the second ventilation structure 12 is arranged under the eyes, the first ventilation structure 11 is provided with a plurality of ventilation holes 11*a*, and the second ventilation structure 12 is provided with an air inlet duct arranged toward the upper side in the height direction of the air inlet mask 10, the front side of the air inlet mask 10 is semi-closed or fully closed, and the air blown by the air supply pipe 20 partially or completely passes into the first ventilation structure 11 and the second ventilation structure 12, and the diameter of the filter holes of the filter screen 30 is not greater than 2 mm. As shown in FIG. 3, the air inlet mask 10 in the embodiment of the present invention is substantially dimensioned to cover the part of the face below the eyes. In addition, it should be noted here that the semi-closed or fully closed configuration of the air inlet mask 10 represents two ways in which the air sent from the air supply pipe 20 at the front end of the air inlet mask 10 enters the first ventilation structure 11 and the second ventilation structure 12. Specifically, according to the semi-closed configuration, the front end of the air inlet mask 10 is open and an air inlet space is formed through cooperation with the headgear. According to the fully closed configuration, a cover is added to the front end of the mask, so that the air sent from the air supply pipe 20 enters the first ventilation structure 11 and the second ventilation structure 12 from the space between the cover and the air inlet mask 10. By replacing the direct blowing method in the prior art by the present invention which allows the air to enter the air inlet space from the opposite direction and then be filtered, the discomfort caused by the wind pressure of the aerodynamic source directly applied to the face can be reduced.

Figure 4:
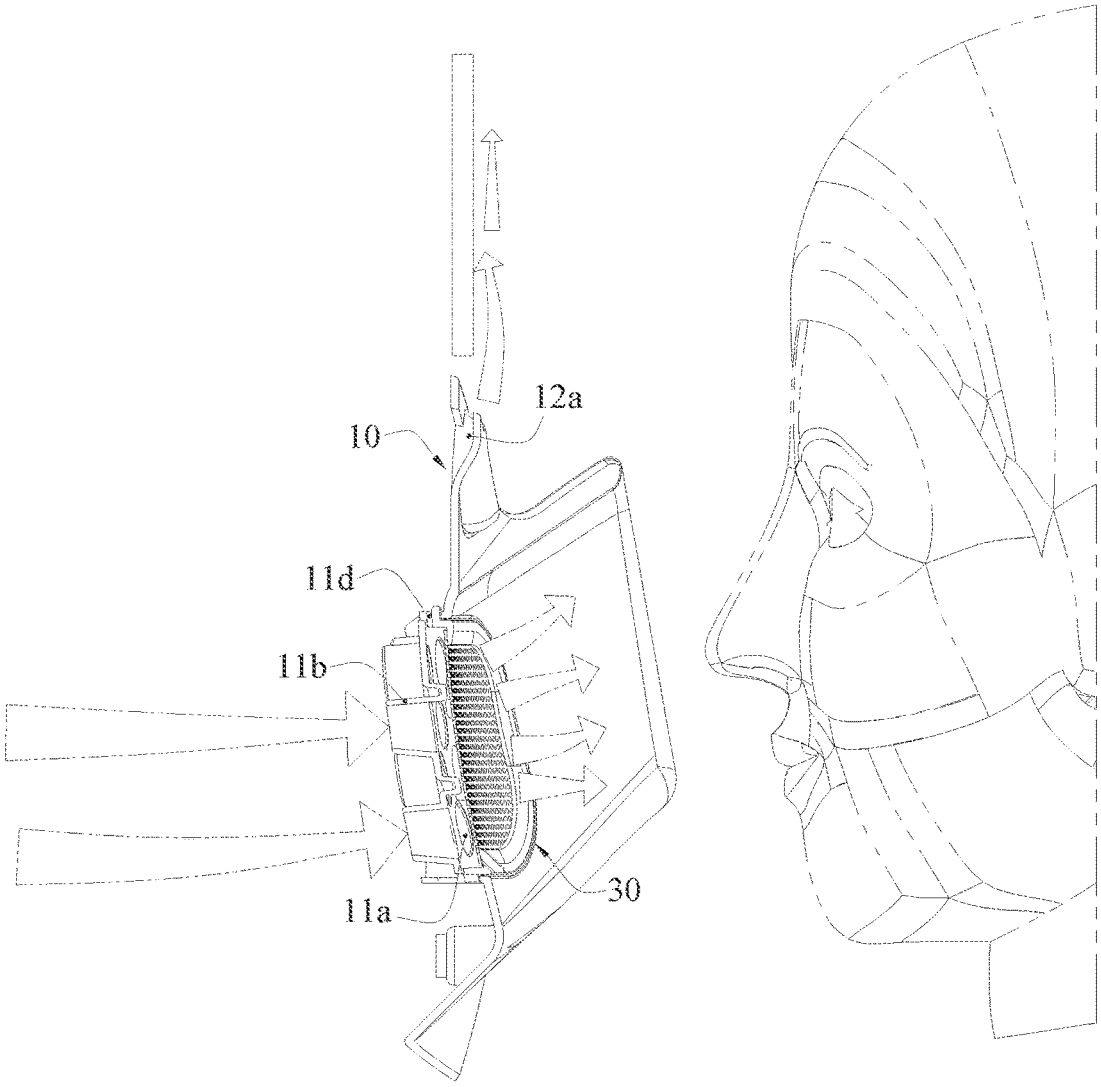
FIG. 4 is a cross-sectional view along the line A-A in FIG. 3 and a schematic diagram of the wearing structure according to an embodiment of the present invention.
Figure 5:
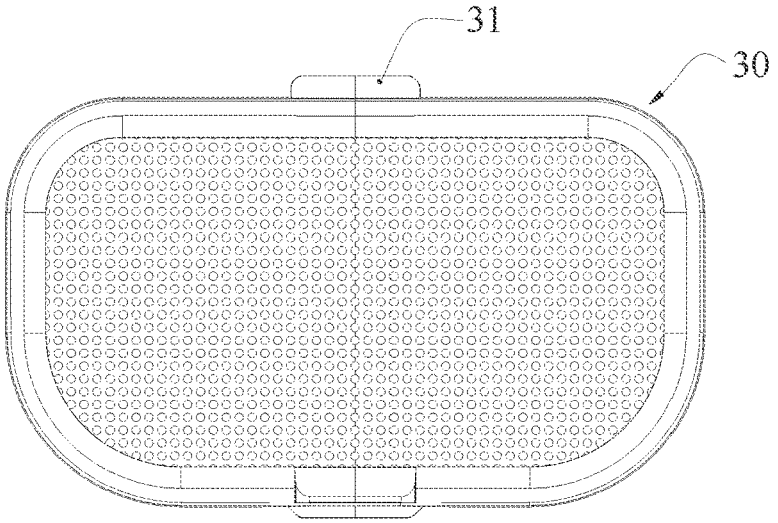
FIG. 5 is a front view of the filter screen according to an embodiment of the present invention.
Figure 6:
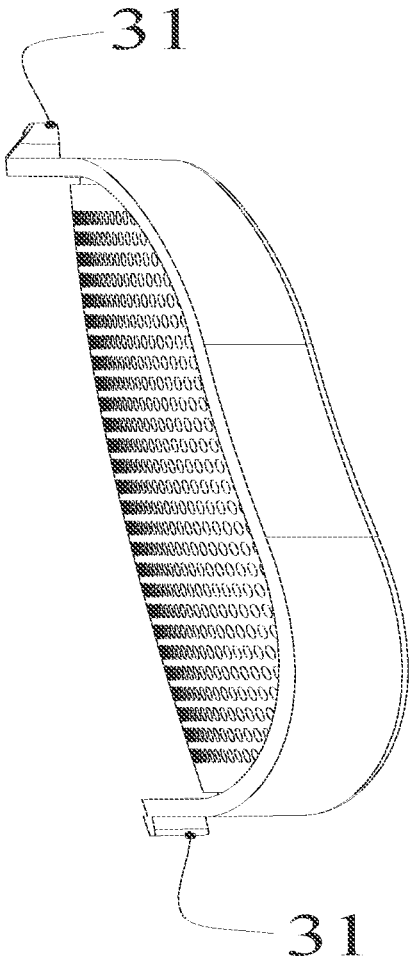
FIG. 6 is a side view of FIG. 5 according to an embodiment of the present invention.

In specific implementation, as shown in FIGS. 2 and 4, the air enters from the rear end of the air supply pipe 20 and exits from the front end, and then enters the air inlet mask 10 through the first ventilation structure 11 and the second ventilation structure 12. The air passing through the first ventilation structure 11 needs to be filtered by the filter screen 30 before contacting with the human mouth and nose area. The second ventilation structure 12 is provided with an air inlet channel 12*a* as shown in FIG. 4 from the inside of the air inlet mask 10, the air inlet channel 12*a* blows from the inside to the lens on the observation window, thereby preventing the lens from fogging and affecting the observation.

In the above embodiment, with the arrangement of the ventilation holes at the first ventilation structure 11 on the air inlet mask 10 and the filter screen 30 fixed at the first ventilation structure 11, the wind entering the mouth and nose from the first ventilation structure 11 becomes more soft and delicate after being filtered through the filter screen 30, improving the comfort of human body when wearing it. In addition, with the arrangement of the second ventilation structure 12, the air inlet duct blows from the inside of the air inlet mask 10 to the observation window 41 of the headgear (see FIG. 7), preventing the window from fogging and improving the reliability of use.

On the basis of the above-mentioned embodiment, in order to make the air blown to the human face more uniform and delicate, the plurality of ventilation holes 11*a* is provided with a ventilation pipe 11*b*, one end of the ventilation pipe 11*b* is connected to the front of the air inlet mask 10 where the ventilation hole 11*a* is located, and the other end extends away from the air inlet mask 10, as shown in FIGS. 1-4. The ventilation pipe 11*b* protrudes from the air inlet mask 10, so that the air blown from the air supply pipe 20 to the air inlet mask 10 cannot directly enter the ventilation holes 11*a*, but needs to pass through the air inlet pipe and then enter the ventilation holes 11*a*. This arrangement forces the flow of air entering the air inlet mask 10 to change its direction again, so that the air entering the air inlet mask 10 is uniformly blown to the face.

Further, in the embodiment of the present invention, the shape of the ventilation pipe 11*b* is improved. As shown in FIG. 4, the diameter of the end of the ventilation pipe 11*b* away from the air inlet mask 10 is less than the diameter of the end close to the air inlet mask 10. That is, in the embodiment of the present invention, the ventilation pipe 11*b* is provided with a tapered structure having a variable section with gradually increasing diameter. With this arrangement, the wind speed can be stabilized, and the air blown to the human face is more delicate and uniform.

In the embodiment of the present invention, only one side of the air inlet mask 10 is provided with the air supply pipe 20 in order to save space. To ensure the uniform flow of the air delivered by the air supply pipe 20, the first ventilation structure 11 also includes an enclosure 11*c* arranged perpendicular to the body of the air inlet mask 10 and surrounding the plurality of the ventilation holes 11*a* to form an air inlet chamber. With the enclosure 11*c*, the air blown from the side cannot directly enter the first ventilation structure 11. The enclosure 11*c* distributes a portion of the air to the direction of the second ventilation structure 12, so that both the first ventilation structure 11 and the second ventilation structure 12 can obtain the required air volume, ensuring reliable operation of the mechanism.

In addition, in order to ensure uniform distribution of air distributed into the first ventilation structure 11, the height of the enclosure 11C close to the air supply pipe 20 is lower than that away from the air supply pipe 20. With such structural arrangement, the ventilation holes 11*a*/ventilation pipe 11*b* far away from the air supply pipe 20 can also obtain uniform wind pressure. In the above embodiment, with the specially structured enclosure 11C, not only the first ventilation structure 11 and the second ventilation structure 12 obtain uniform wind pressure, but also the interior of the first ventilation structure 11 obtains uniform wind pressure, thus improving the comfort of the human body and reliable operation of the mechanism.

In addition, in order to reduce the wind resistance of air entering the enclosure 11C, in the embodiment of the present invention, as shown in FIGS. 1 to 4, the enclosure 11*c* is arranged open at a central position between the upper and lower sides in the height direction of the air inlet mask 10.

In order to improve the fixing strength of the air supply pipe 20, in the embodiment of the present invention, as shown in FIG. 1, the length direction of the air supply pipe 20 is substantially perpendicular to the body of the air inlet mask 10, the side of the air inlet mask 10 is recessed inward to form a fixing groove 13, the side wall of the fixing groove 13 is arranged to replicate the shape of the side wall where the air supply pipe 20 is fixed. It should be noted here that "substantially perpendicular to" means that when the air inlet mask 10 is worn, the air supply pipe 20 fits to the person's side face, and one end of the air supply pipe 20 is fixed to the side of the air inlet mask 10. In this case, the side wall of the air supply pipe 20 also partly fits to the air inlet mask 10, so that the fixing groove 13 plays a fixing role.

In the embodiment of the present invention, the filter screen 30 is detachable for easy replacement.

Specifically, the filter screen 30 is fixed in the air inlet mask 10 by fasteners, for example, screws, and can be disassembled with a tool when it needs to be replaced.

In a preferred embodiment, as shown in FIGS. 3-6, a snap structure 31 is provided at a central position between two ends of the filter screen 30 in the width direction. The first ventilation structure 11*a* is provided with a bayonet 11*d* corresponding to the snap structure 11*a*, and the snap structure 11*a* is detachably seated in the bayonet 11*d*. The snap structure 31 here is in the form of a snap formed by extending the end of the filter screen forward and then bending it towards the upper and lower sides. In the embodiment of the invention, the filter screen 30 can be made of plastic, so as to allow certain deformation when fixing and removing the filter screen 30, facilitating the installation and removal of the filter screen 30.

Figure 7:
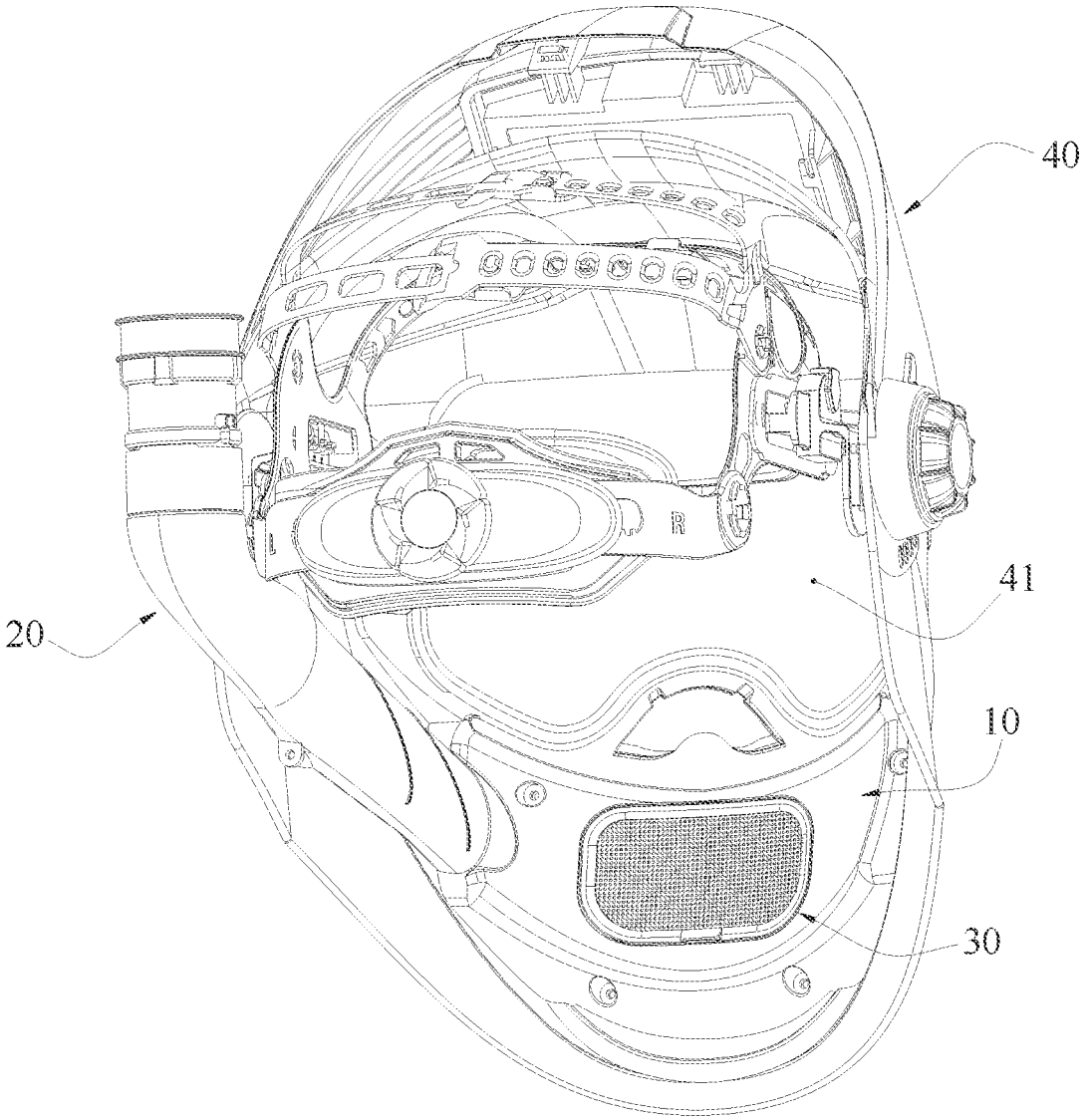
FIG. 7 is a schematic diagram of the structure of the headgear according to an embodiment of the present invention.

The embodiment of the present invention also provides a headgear as shown in FIG. 7, comprising an air supply mechanism with lower air duct described above and a semi-open hood 40, the semi-open hood 40 including an internal space for at least covering the human face and an observation window 41 at its front end, the air supply mechanism with lower air duct being fixed inside the semi-open hood 40.

The edge of the air inlet mask 10 in the air supply mechanism with lower air duct extends and bends toward the direction of the semi-open hood, so as to form an air inlet chamber between the air inlet mask 10 and the semi-open hood 40. In the present invention, in order to save materials, the air inlet mask 10 in the air supply mechanism with lower air duct adopts a semi-closed structure, and the air inlet chamber is formed by cooperation of the air inlet mask 10 and the semi-open hood 40.

In the embodiment of the present invention, the semi-open hood 40 means that when a worker wears it, the entire hood is fixed on the front of the worker's face only by a head-mounted structure at the back of the worker's head. Through this arrangement, the air entering toward the face through the air inlet mask 10 is directly blown out from the edge of the hood. Therefore, on the one hand, the wearer feels comfortable, on the other hand, it also makes the inlet air blow out along the face to form a barrier to reduce the impact of external air on the face.

Of course, it should be pointed out here that the air supply mechanism with lower air duct of the present invention is also applicable to a closed hood.

Figure 8:
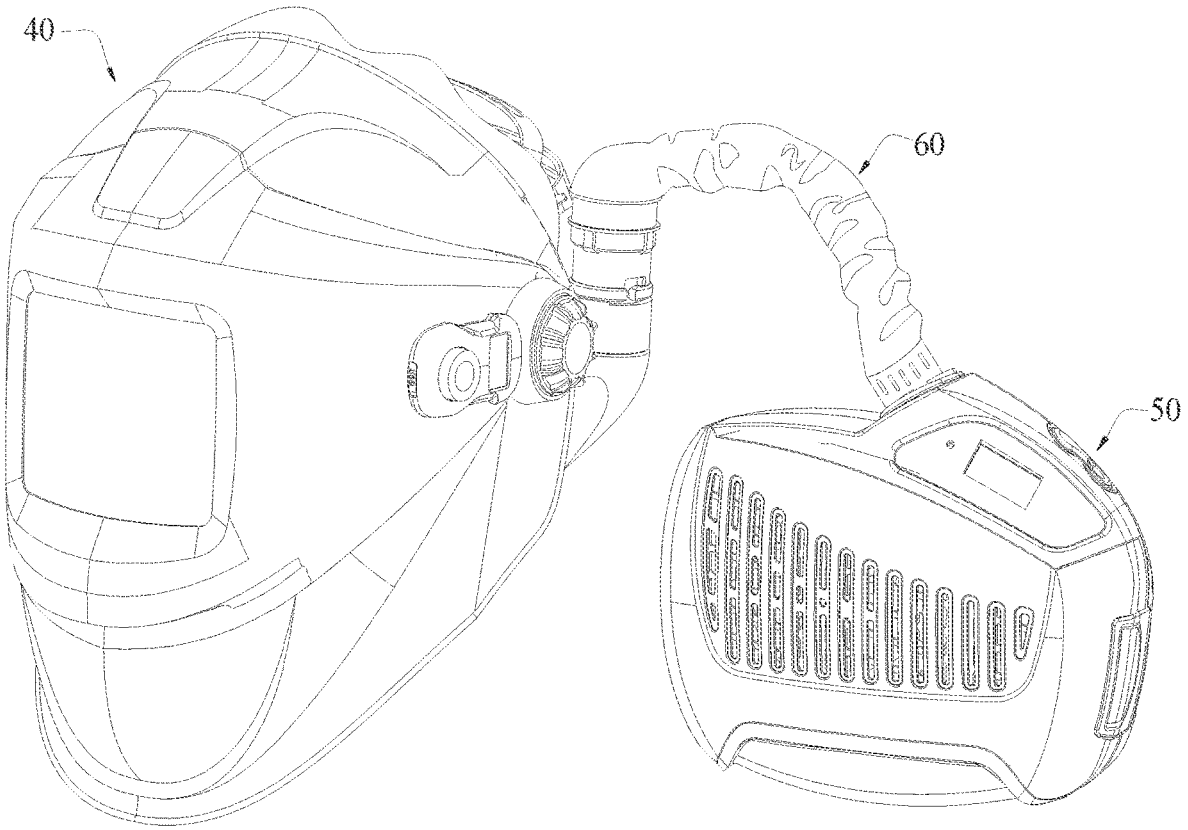
FIG. 8 is a schematic diagram of the connection structure of the electric protection equipment according to an embodiment of the present invention.

The embodiment of the present invention also provides an electric protective equipment as shown in FIG. 8, comprising a headgear described above, a filter-type blower 50, and a connecting hose 60 connected to the filter-type blower 50 at one end and the air supply pipe 20 in the air supply mechanism with lower air duct at the other end. The filter-type forced blower 50 is known in the prior art, and its detailed structure will not be repeated here. The inhaled air is filtered through the filter 30 and then sent to the headgear. It can be powered by a battery and is easy to carry. The connecting hose 60 is a common connecting pipe with two ends respectively connected to the air supply pipe 20 and the filter-type blower 50.

In the embodiment of the present invention, a wind adjusting mechanism is also provided. When working in cold weather, the hot air breathed by people is more likely to make the observation window of the headgear foggy. To solve this problem, the embodiment of the present invention provides an automatic adjustment mechanism, comprising a pressure sensor fixed inside the filter screen, and a connecting end 21 arranged between the air supply pipe and the connecting hose. The connecting end 21 is provided with a small motor driving the blades to rotate and a controller connected to the pressure sensor and the small motor respectively. When the observation window is not fogged, the blades are free to rotate with the wind direction in the air supply pipe 20 inside the connecting end; when the observation window is fogging, the operator blows toward the pressure sensor to change the parameters of the pressure sensor, so as to trigger the controller to drive the small motor to rotate. The speed of the small motor is greater than the natural rotation speed of the blades, thus the air flow into the headgear is increased. Through such arrangement, the defogging operation can be realized just by the operator blowing air, improving the ease of use. Since the pressure sensor is disposed at the inner edge of the filter screen, the wind blowing toward the inside of the filter screen will not affect the action of the pressure sensor. It should be noted that the pressure sensor is known in the prior art and its detailed principle and structure will not be repeated here. By arranging the sensor at the inner edge of the filter screen 30, in the embodiment of the present invention, at the upper edge, it is possible to give the operator a feeling of defogging through mouth blowing, which is more intuitive and convenient. Moreover, the connecting end 21 is easy to install and remove, and it is also convenient for functions to be added or removed according to user requirements, improving the applicability of the product.

Those skilled in the industry should understand that the present invention is not limited by the foregoing embodiments. The foregoing embodiments and descriptions only illustrate the principles of the present invention. Without departing from the spirit and scope of the present invention, the present invention will have various changes and improvements, which fall within the scope of the claimed invention. The scope of protection claimed by the present invention is defined by the appended claims and their equivalents.

The invention claimed is:

1. An air supply mechanism with a lower air duct, comprising:

an air inlet mask, the front of the air inlet mask being raised in an arc shape and the back of the air inlet mask being arranged to fit to a human face, the air inlet mask including a first ventilation structure and a second ventilation structure connecting the front and back;

an air supply pipe fixed on one side of the air inlet mask and in communication with the first ventilation structure and the second ventilation structure to supply air to the front of the air inlet mask; and a filter screen fixedly covering the first ventilation structure to filter the air entering the first ventilation structure from the front of the air inlet mask;

wherein when the air inlet mask fits to the human face, the first ventilation structure is arranged at the position of the nose and mouth and the second ventilation structure is arranged under the eyes, the first ventilation structure is provided with a plurality of ventilation holes, and the second ventilation structure is provided with an air inlet duct arranged toward an upper side in the height direction of the air inlet mask, the front side of the air inlet mask is semi-closed or fully closed, and the air blown by the air supply pipe partially or completely passes into the first ventilation structure and the second ventilation structure, and the diameter of filter holes of the filter screen is not greater than 2 mm, wherein the plurality of ventilation holes is provided with a ventilation pipe, one end of the ventilation pipe is connected to the front of the air inlet mask where the ventilation holes are located, and the other end extends away from the air inlet mask, wherein the diameter of the end of the ventilation pipe away from the air inlet mask is less than the diameter of the end close to the air inlet mask, wherein the first ventilation structure further includes an enclosure arranged perpendicular to the body of the air inlet mask and surrounding the plurality of the ventilation holes to form an air inlet chamber, wherein the height of the enclosure close to the air supply pipe is lower than the height of the enclosure away from the air supply pipe, and wherein the enclosure is arranged open at a central position between the upper side and a lower side in the height direction of the air inlet mask.

2. The air supply mechanism with lower air duct according to claim 1, wherein the length direction of the air supply pipe is substantially perpendicular to the body of the air inlet mask, the one side of the air inlet mask is recessed inward to form a fixing groove, a side wall of the fixing groove is arranged to replicate the shape of a side wall where the air supply pipe is fixed.

3. The air supply mechanism with lower air duct according to claim 1, wherein the filter screen is detachably fixed to the air inlet mask;

the filter screen is fixed in the air inlet mask by fasteners; or a snap structure is provided at a central position between two ends of the filter screen in the width direction, the first ventilation structure is provided with a bayonet corresponding to the snap structure, and the snap structure is detachably seated in the bayonet.

4. A headgear, comprising:

an air supply mechanism with lower air duct according to claim 1 and a semi-open hood, the semi-open hood including an internal space for at least covering the human face and an observation window at its front end, the air supply mechanism with lower air duct being fixed inside the semi-open hood;

wherein an edge of the air inlet mask in the air supply mechanism with lower air duct extends and bends toward a direction of the semi-open hood, so as to form an air inlet chamber between the air inlet mask and the semi-open hood.

5. An electric protective equipment comprising a headgear according to claim 4, a filter-type blower, and a connecting hose connected to the filter-type blower at one end and the air supply pipe in the air supply mechanism with lower air duct at the other end.

* * * * *